US011786806B2

(12) United States Patent
Hendrik Van Ee

(10) Patent No.: US 11,786,806 B2
(45) Date of Patent: Oct. 17, 2023

(54) ALPHACUBE

(71) Applicant: Jonathan Hendrik Van Ee, Dublin, CA (US)

(72) Inventor: Jonathan Hendrik Van Ee, Dublin, CA (US)

( * ) Notice: Subject to any disclaimer, the term of this patent is extended or adjusted under 35 U.S.C. 154(b) by 49 days.

(21) Appl. No.: 17/305,450

(22) Filed: Jul. 7, 2021

(65) Prior Publication Data

US 2022/0040565 A1 Feb. 10, 2022

Related U.S. Application Data

(60) Provisional application No. 62/706,237, filed on Aug. 6, 2020.

(51) Int. Cl.

| | |
|---|---|
| ***A63F 9/08*** | (2006.01) |
| ***E04B 2/42*** | (2006.01) |
| ***E01C 5/00*** | (2006.01) |
| *E04B 2/02* | (2006.01) |
| *A63H 33/04* | (2006.01) |

(52) U.S. Cl.

CPC ..... *A63F 9/0865* (2013.01); *E01C 5/00* (2013.01); *E04B 2/42* (2013.01); *A63H 33/04* (2013.01); *E04B 2002/0256* (2013.01)

(58) Field of Classification Search

CPC ..... A63H 33/04; A63F 9/0865; E04B 2/42; E04B 2002/0256; E01C 5/00

USPC ..... 434/160

See application file for complete search history.

(56) References Cited

U.S. PATENT DOCUMENTS

| | | | | | |
|---|---|---|---|---|---|
| 400,087 | A * | 3/1889 | Jones | 434/160 | |
| 3,747,261 | A * | 7/1973 | Salem | B23Q 1/545 | 446/124 |
| 4,428,732 | A * | 1/1984 | Meyer | A63F 9/12 | 273/157 R |
| 4,792,319 | A * | 12/1988 | Svagerko | A63H 33/08 | 446/104 |
| 4,877,405 | A * | 10/1989 | Stewart | G09F 7/14 | 434/160 |
| 5,620,324 | A * | 4/1997 | Rettke | G09B 1/40 | 434/193 |
| 6,050,873 | A * | 4/2000 | Reisman | A63H 33/062 | 446/128 |
| 2005/0075035 | A1* | 4/2005 | Hatting | A63H 33/101 | 446/85 |
| 2012/0032393 | A1* | 2/2012 | Leicht | A63H 33/107 | 273/156 |
| 2013/0165012 | A1* | 6/2013 | Klauber | A63H 33/04 | 446/102 |
| 2018/0339237 | A1* | 11/2018 | Lim | A63H 33/106 | |
| 2020/0238190 | A1* | 7/2020 | Tusacciu | A63H 33/08 | |
| 2021/0282373 | A1* | 9/2021 | Boileau | A63H 33/062 | |

* cited by examiner

*Primary Examiner* — William V Gilbert

(57) ABSTRACT

The Alphacube invention is a collection of modular shapes that form cubes, each letter of the alphabet and that are a twisty cube puzzle that can be solved for each letter of the alphabet. The pieces can both build structures and communicate verbal messages. They are a toy, puzzle, and an educational tool to teach literacy in a fun and engaging way. The pieces can also be assembled into artistic shapes or into basic shapes that describe animals and simple things like a small hole on a flat surface.

1 Claim, 19 Drawing Sheets

ALPHACUBE

BACKGROUND OF THE INVENTION

Field of the Invention

The Alphabet Building Block System ("Invention") is a collection of discreet shapes that, when arranged into a square with nine segments, write every letter in the alphabet; when the arranged into an equilateral six-sided twisty cube puzzle with 27 movable block pieces, that puzzle that can be solved for each letter of the alphabet.

Description of Related Art

Void Cube (registered as The Void Puzzle®) uses a different mechanism to create a twisty cube puzzle with an empty center.

Illuminated modular bars have formed the basis for writing the alphabet in two dimensions.

BRIEF SUMMARY OF THE INVENTION

The Invention empowers restaurants and businesses that need signs to have modular blocks that can be assembled into a desired message. As the message changes, the blocks can be changed.

Children can learn how to both build houses and other structures, while also learning how to write letters, spell words and write phrases.

The Invention is a twisty cube puzzle that can be used in competitions to not only solve 3D puzzles but to also solve verbal puzzles at the same time, like riddles, and to write answers to competition questions with the modular shapes that make letters.

BRIEF DESCRIPTION OF THE SEVERAL VIEWS OF THE DRAWINGS

FIG. 4 is snapped into FIG. 3. Additional parts of the Invention can be affixed to that hook.

FIG. 10B is a view of FIG. 10A from the outside.

" FIG. 16A is also a full black piece on the other outer side.

Figure 2:
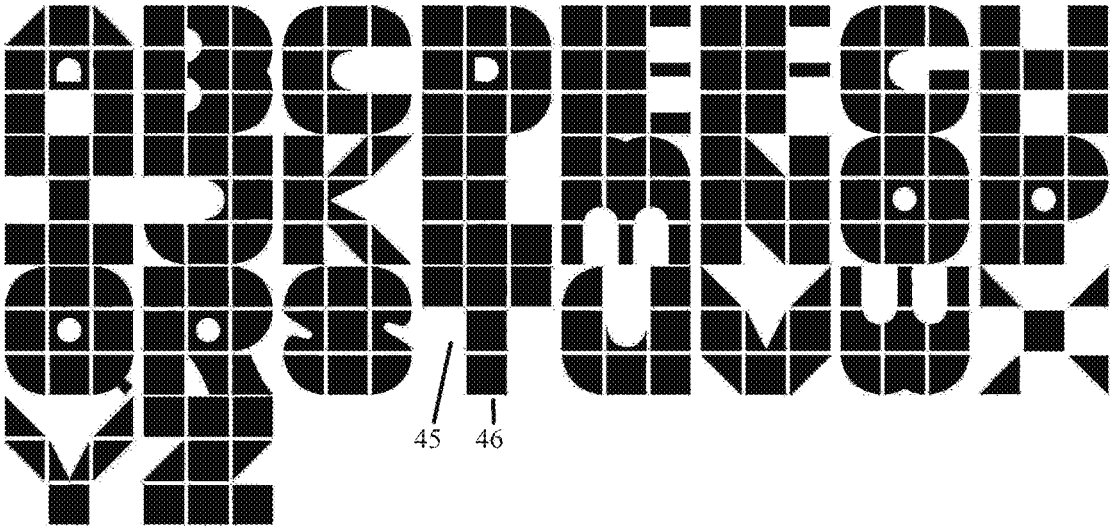
FIG. 2 is a profile view of each letter of the alphabet once it is written by arranging the modular pieces of the invention appropriately.

The ends of FIG. 40-FIG. 60 contain the shapes that are found in FIG. 2 so that FIGS. 40 through 60 are modular blocks that assemble into those letters.

DETAILED DESCRIPTION OF THE INVENTION

Figure 1A:
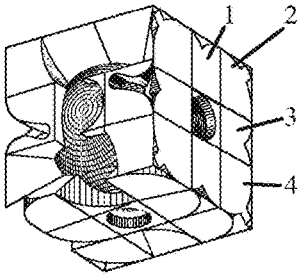
FIG. 1A is a view from a bottom corner of a twisty cube with 26 movable cube parts that can also spell every letter of the alphabet.
Figure 1B:
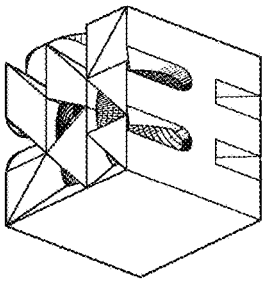
FIG. 1B is a view of FIG. 1A from a different angle.
Figure 1C:
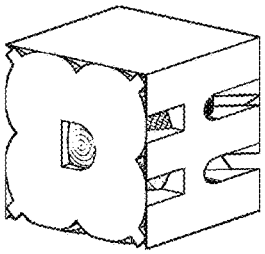
FIG. 1C is a view of FIG. 1A from a different angle.
Figure 1D:
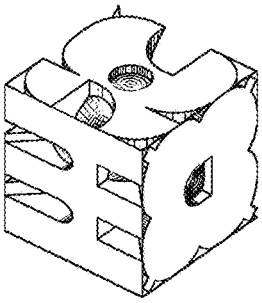
FIG. 1D is a view of FIG. 1A from a different angle.
Figure 1E:
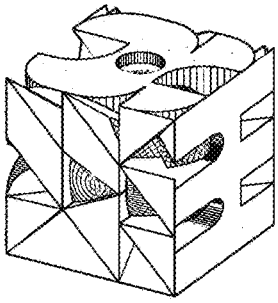
FIG. 1E is a view of FIG. 1A from a different angle.
Figure 1F:
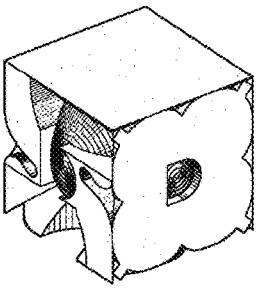
FIG. 1F is a view of FIG. 1A from a different angle.
Figure 1G:
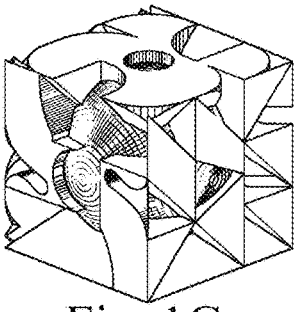
FIG. 1G is a view of FIG. 1A from a different angle.
Figure 1H:
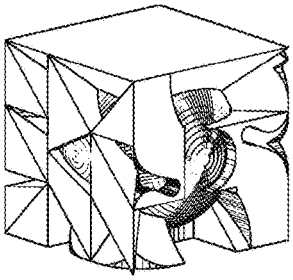
FIG. 1H is a view of FIG. 1A from a different angle.

FIG. 1A is a view from a bottom corner of a twisty cube with 26 movable cube parts (1, 2, 3, 4) that can also spell every letter of the alphabet.

FIG. 1A, FIG. 1B, FIG. 1C, FIG. 1D, FIG. 1E, FIG. 1F, FIG. 1G and FIG. 1H are different views of an artistic solution to a twisty cube with 26 movable cube parts that can also spell every letter of the alphabet.

FIG. 2 is a profile view of each letter of the alphabet once it is written by arranging the modular pieces of the Invention appropriately.

Figure 3A:
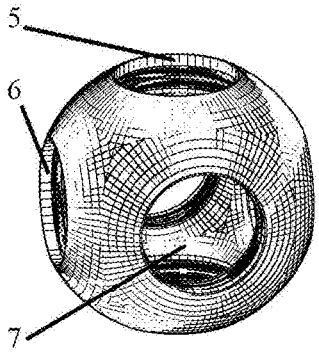
FIG. 3A is a sphere with holes onto which outside pieces can snap and pivot.

FIG. 3A is a sphere with holes (5, 6, 7) onto which outside pieces can snap and pivot.

Figure 3B:
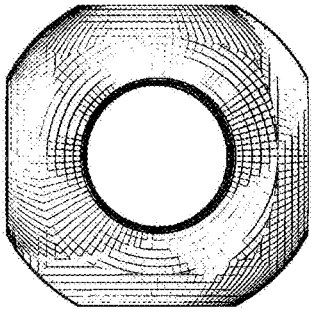
FIG. 3B is a profile view of FIG. 3A.
Figure 3C:
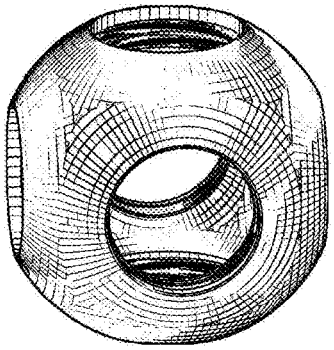
FIG. 3C is a view from a top side of FIG. 3A.
Figure 4A:
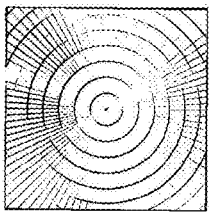
FIG. 4A is a top profile view of FIG. 4C.
Figure 4B:
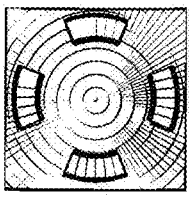
FIG. 4B is a bottom profile view of FIG. 4C.
Figure 4C:
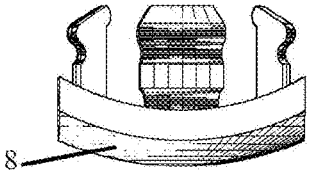
FIG. 4C is a part of a sphere that snaps into the openings in FIG. 3A as is shown in FIG. 5.
Figure 4D:
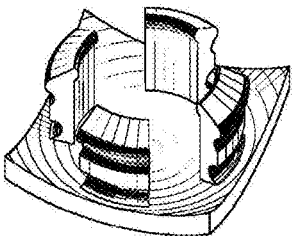
FIG. 4D is a view from a bottom corner of FIG. 4C.
Figure 5:
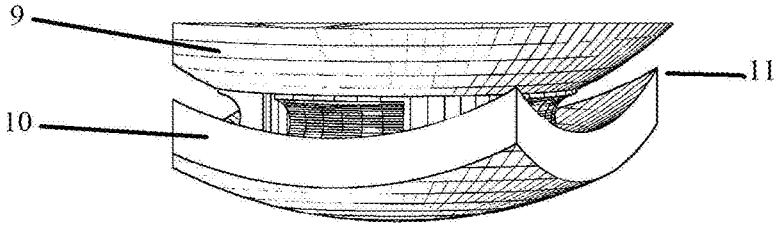
FIG. 5, at element 11, is a hook formed when

FIG. 4C is a part of a sphere (8) that snaps into the openings in FIG. 3A (5, 6, 7) as is shown in FIG. 5 where FIG. 4C (10) is inserted into FIG. 3A (9), FIG. 5, at element 11, is a hook formed when FIG. 4 (10) is snapped into FIG. 3 (9). Additional parts of the Invention can be affixed to that hook (11).

Figure 6:
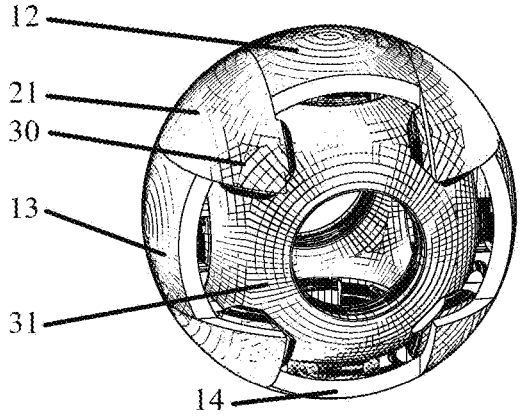
FIG. 6 shows multiple FIG. 4A pieces snapped into FIG. 3A with additional parts hooked onto FIG. 4A.

FIG. 6 shows multiple FIG. 4A pieces snapped into FIG. 3A with additional parts hooked onto FIG. 4A.

Figure 7A:
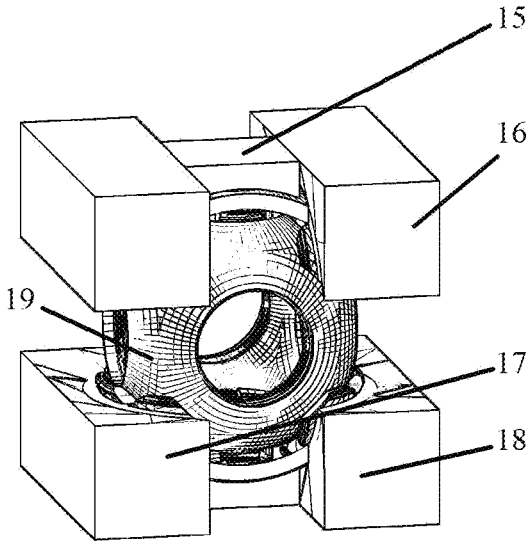
FIG. 7A shows the view when all pieces snapped or hooked together in the manner outlined above are extended to form a cube around the sphere that is FIG. 3A.
Figure 7B:
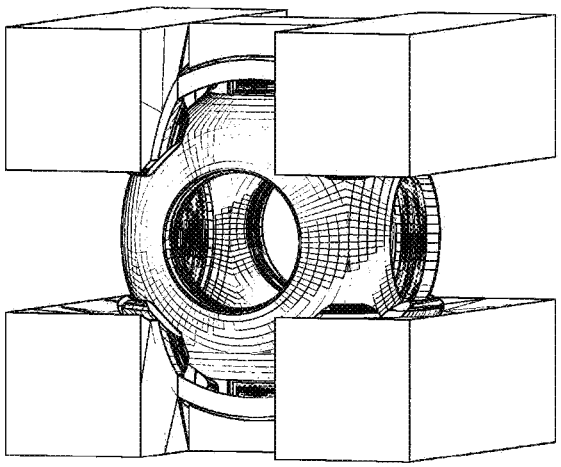
FIG. 7B is a view of FIG. 7A from a different angle.

FIG. 7A shows the view when all pieces snapped or hooked together in the manner outlined above are extended to form a cube (15, 16, 17, 18) around the sphere that is FIG. 3A (19).

Figure 8A:
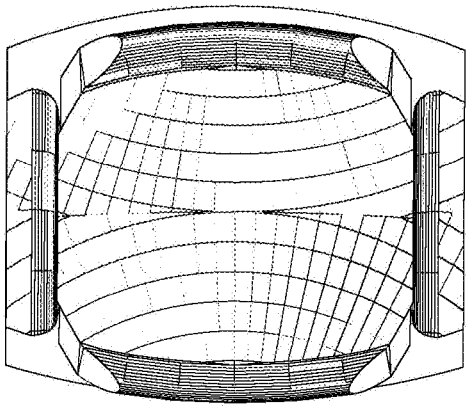
FIG. 8A is a profile view from the inner side of FIG. 8B.
Figure 8B:
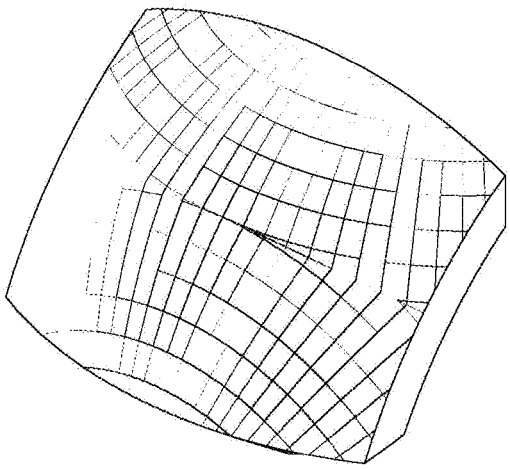
FIG. 8B is a part of a sphere that hooks into the hook shown in FIG. 5 to form part of the outer smooth spherical surface shown in FIG. 6.
Figure 8C:
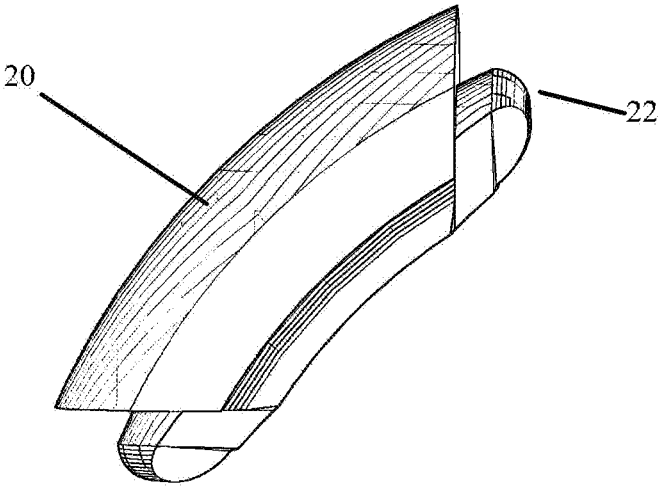
FIG. 8C is a profile view from the side of FIG. 8B.

FIG. 8C is a part of a sphere (20) that hooks (22) into the hook shown in FIG. 5 (11) to form part of the outer smooth spherical surface shown in FIG. 6 (21).

Figure 9A:
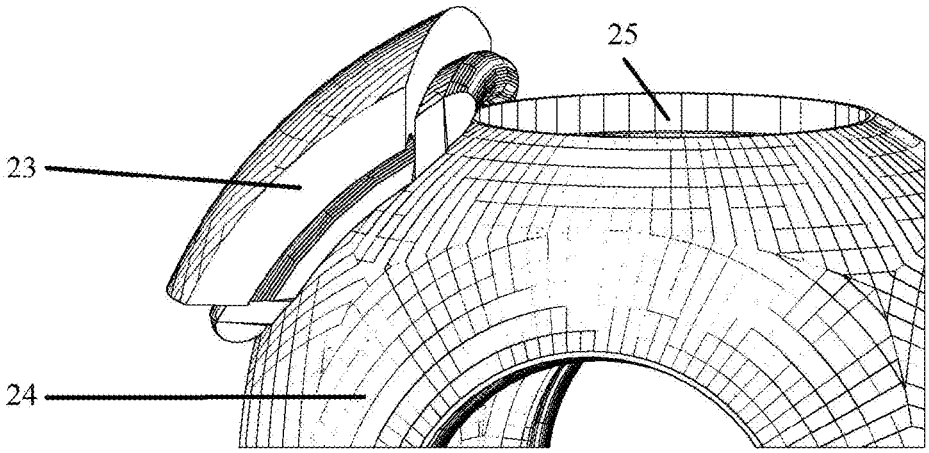
FIG. 9A shows FIG. 8A resting on FIG. 3A in a location where FIG. 4A can be inserted into the hole at the top of FIG. 3A to snap onto FIG. 3A and hold FIG. 8A onto FIG. 3A with the hook shown in FIG. 5 at element 11.

FIG. 9A shows FIG. 8A (23) resting on FIG. 3A (24) in a location where FIG. 4A can be inserted into the hole at the top of FIG. 3A (25) to snap onto FIG. 3A (24) and hold FIG. 8A (23) onto FIG. 3A (24) with the hook shown in FIG. 5 at element 11.

Figure 9B:
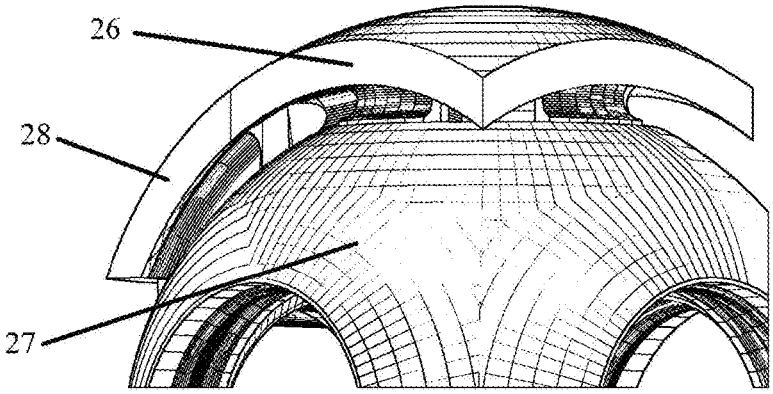
FIG. 9B at element 26 is FIG. 4A snapped into the sphere that is FIG. 3A to hold FIG. 8A, which is identified as element 28.

FIG. 9B at element 26 is FIG. 4A snapped into the sphere that is FIG. 3A (27) to hold FIG. 8A, which is identified as element 28.

Figure 10A:
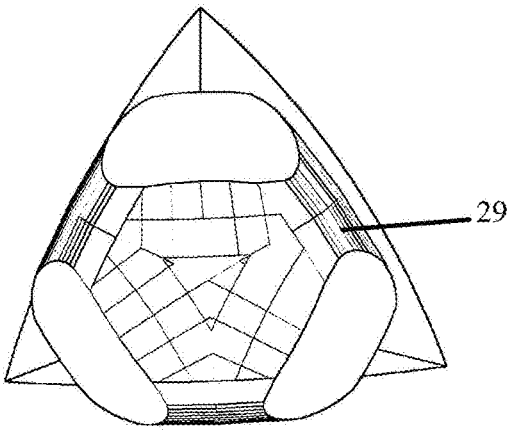
FIG. 10A is a view of the inside hook side of the piece that appears on FIG. 6 to block the shine on the sphere that is FIG. 3 in that FIG. 6. It hooks onto FIG. 8C under the outcrop of material at element 28 in FIG. 9B.
Figure 10B:
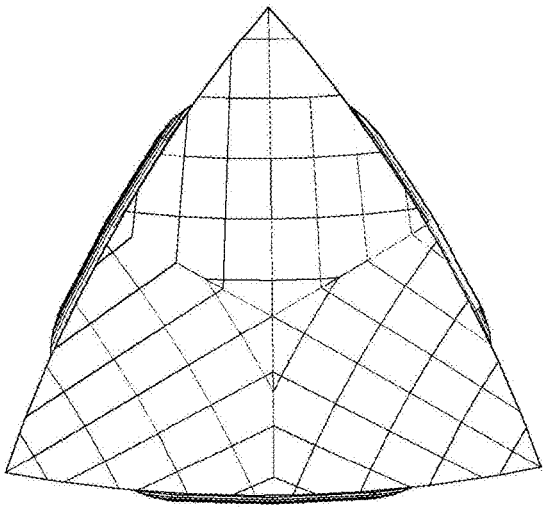
FIGS. 10B and C are different views of the same object.
Figure 10C:
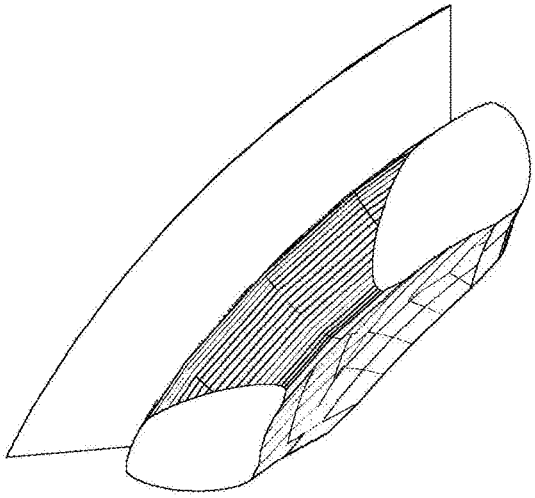
FIG. 10C is a profile view from the side of FIG. 10A.
Figure 11:
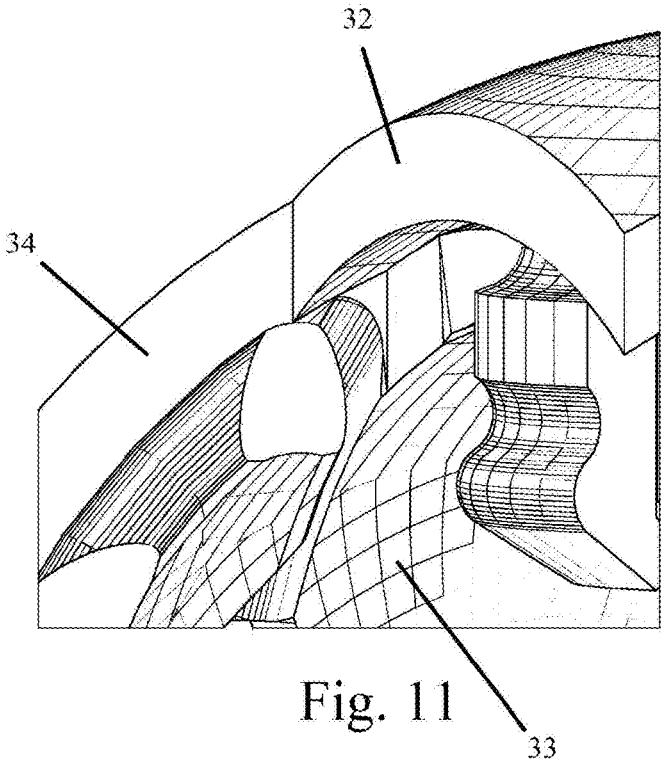
FIG. 11 is a closeup view of the three pieces (FIGS. 4A, 8A and 10A) that fit onto the sphere that is FIG. 3A and rotate or pivot on its surface. They are positioned in the manner they would be when snapped into FIG. 3A but FIG. 3A is now shown for clarity. The area identified as element 32 is where FIG. 10A hooks under the outcrop of FIG. 8A.

FIG. 10A is a view of the inside hook side (29) of the piece (30) that appears on FIG. 6 to block the shine on the sphere that is FIG. 3 (31) in that FIG. 6. It hooks onto FIG. 8C under the outcrop of material at element 28 in FIG. 9B. FIGS. 10B and C are different views of the same object.

FIG. 1*t* is a closeup view of the three pieces (FIG. 4A at element 32, 8A at element 33 and 10A at element 34) that fit onto the sphere that is FIG. 3A and rotate or pivot on its surface. They are positioned in the manner they would be when snapped into FIG. 3A but FIG. 3A is not shown for clarity. The area behind element 34 is where FIG. 10A hooks under the outcrop of FIG. 8A (33).

Figure 12A:
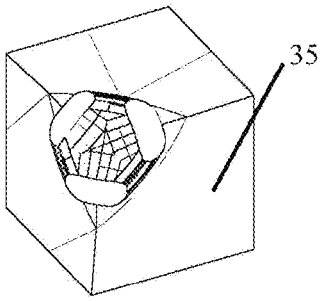
FIG. 12A is FIG. 10A extended from a spherical outer surface to fill out a cube.
Figure 12B:
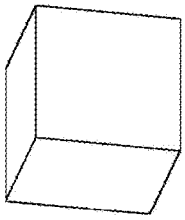
FIG. 12B is another view of FIG. 12A.
Figure 12C:
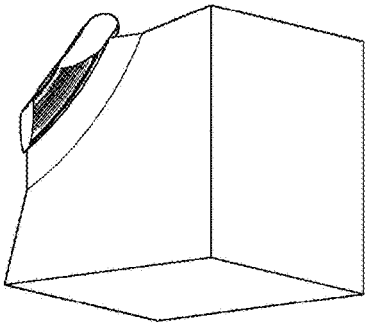
FIG. 12C is another view of FIG. 12A.
Figure 13:
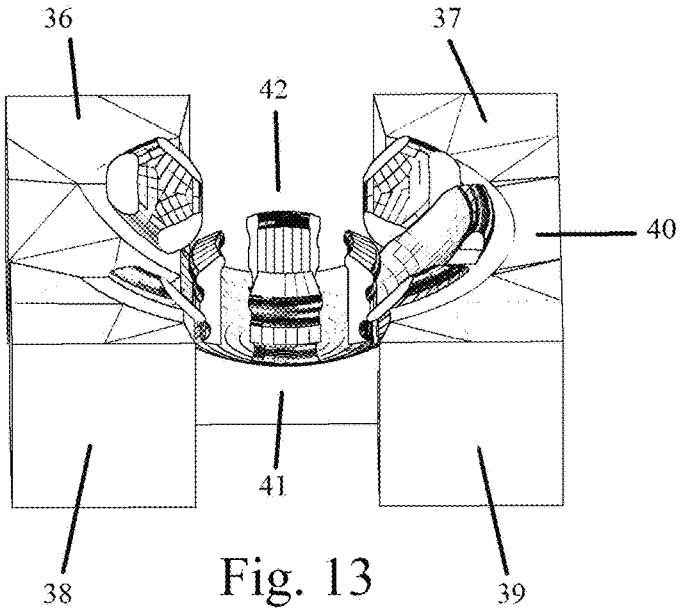
FIG. 13 is an inside view of FIG. 7 without the sphere that is FIG. 3 for clarity.
Figure 14A:
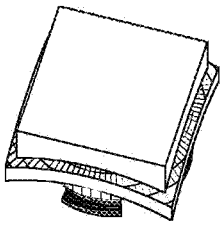
FIG. 14A is a solid center piece.
Figure 14B:
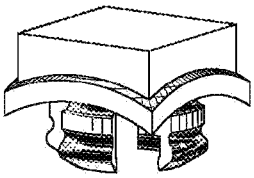
FIG. 14B is a view from the side of FIG. 14A.

FIG. 12A is FIG. 10A extended from a spherical outer surface to fill out a cube (35). FIG. 13 is an example of how FIG. 12A (36, 37, 38, 39) and filled-out versions of FIGS. 8A (40) and 4A (41) would fit into FIG. 3A, which would be right on top of the shapes shown in FIG. 13 (42). For clarity, FIG. 3A is not shown in FIG. 13.

FIGS. 14A-39A are mostly modular sub-parts of each letter of the alphabet that have been carved out of the filled-out cubes shown in FIG. 7A (15, 16, 17, 18).

Figure 15A:
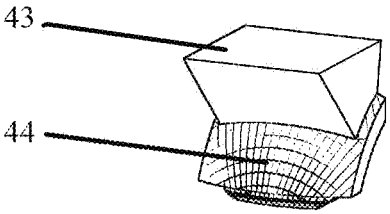
FIG. 15A is a solid middle side piece that is also an empty side piece. Empty areas correspond to the white areas and positive areas correspond to the black areas in the fonts shown in FIG. 2.

FIG. 15A is a solid middle side piece (43) that is also an empty side piece (44). Empty areas correspond to the white areas (45) and positive areas correspond to the black areas (46) in the fonts shown in FIG. 2. For example, the letter "T" in FIG. 2 has an empty white area at its lower left (45) and a black area in the middle (46).

Figure 15B:
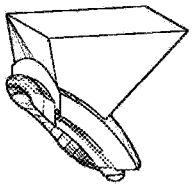
FIG. 15B is a side view of FIG. 15A.

FIG. 15B is a side view of FIG. 15A.

Figure 16A:
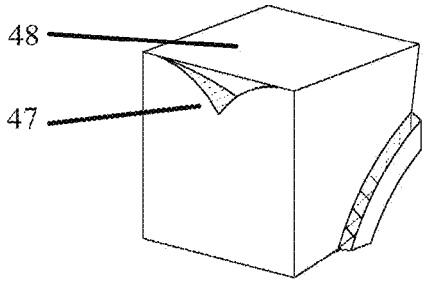
FIG. 16A is the middle right part of the letter "B," which also serves as the bottom center of letter "W" and the top center of the letter "M.
Figure 16B:
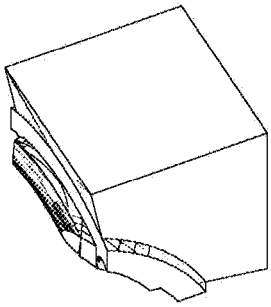
FIG. 16B is a view from a side of FIG. 16A.

FIG. 16A is the middle right part of the letter "B" (47), which also serves as the bottom center of letter "W" (47) and the top center of the letter "M" (47). FIG. 16A is also a full black piece on the other outer side (48).

Figure 17A:
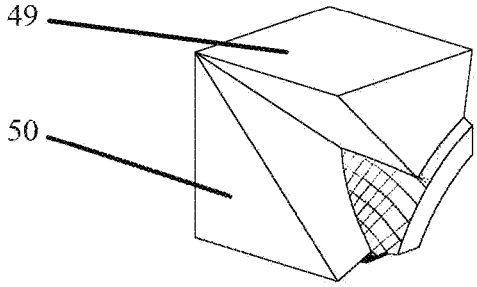
FIG. 17A is a black piece on one side and a triangular piece on the other.
Figure 17B:
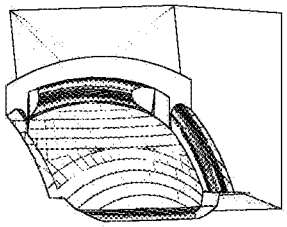
FIG. 17B is a view from the back of FIG. 17A.

FIG. 17A is a black piece on one side (49) and a triangular piece on the other (50).

Figure 18A:
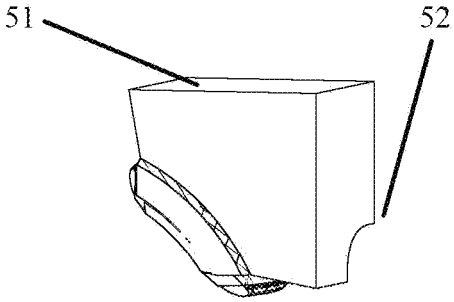
FIG. 18A is a view of FIG. 18B from a different angle.
Figure 18B:
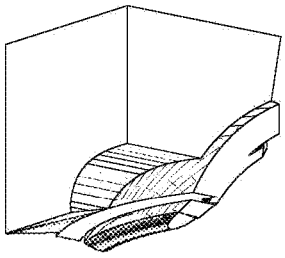
FIG. 18B is a full black piece on one outer side and can form the middle side part of the letter "W."

FIG. 18B is a full black piece on one outer side (51) and can form the middle side part of the letter "W" (52).

Figure 19A:
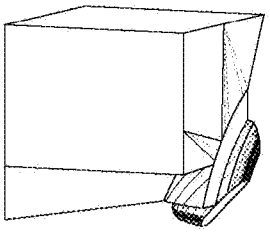
FIG. 19A is another view of FIG. 19B.
Figure 19B:
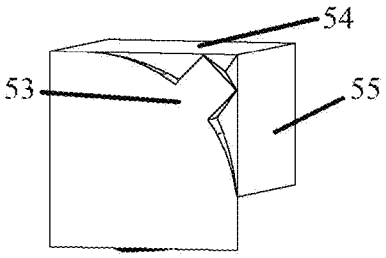
FIG. 19B is the bottom right part of "Q," a full black part and the end of "E" or "W."

FIG. 19B is the bottom right part of "Q" (53) a full black part (54) and the end of "E" or "W" (55).

Figure 20A:
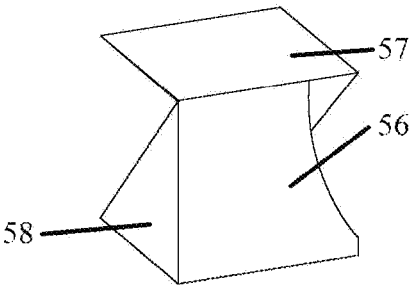
FIG. 20A is the bottom part of the letter "R," a full black part, and a triangular part.
Figure 20B:
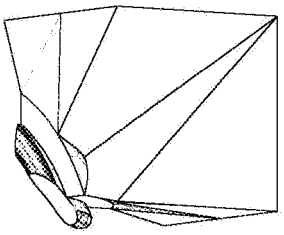
FIG. 20B is another view of FIG. 20A.

FIG. 20A is the bottom part of the letter "R" (56) a full black part (57), and a triangular part (58).

Figure 21A:
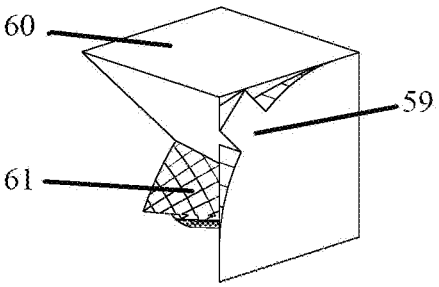
FIG. 21A is also the bottom right part of the letter "Q," a full black side, and a full empty side.
Figure 21B:
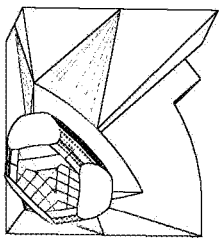
FIG. 21B is another view of FIG. 21A.

FIG. 21A is also the bottom right part of the letter "Q" (59) a full black side (60), and a full empty side (61).

Figure 22A:
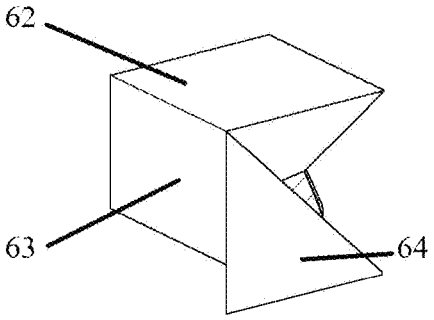
FIG. 22A is a full black side, an partial side that can form the ends of "E" or "W" and a triangular side.
Figure 22B:
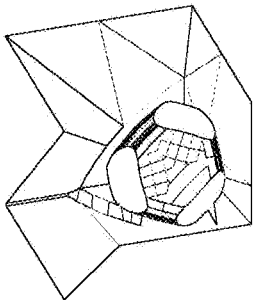
FIG. 22B is another view of FIG. 22A.

FIG. 22A is a full black side (62), a partial side that can form the ends of "E" or "W" (63) and a triangular side (64).

Figure 23A:
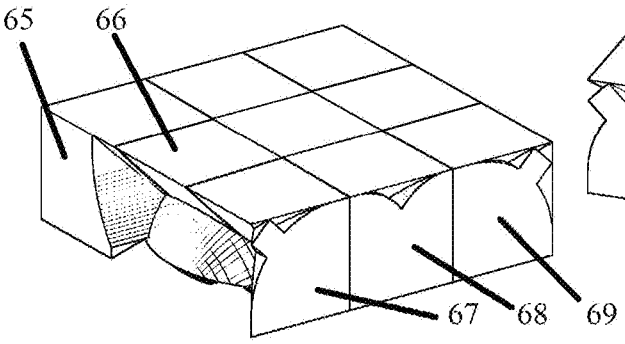
FIG. 23A is views of how the preceding FIG. 14A-22B fit.
Figure 23B:
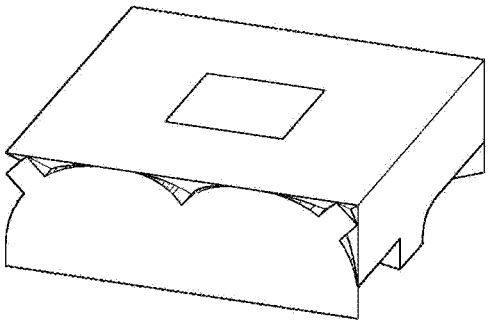
FIG. 23B is a different view of FIG. 23A.
Figure 23C:
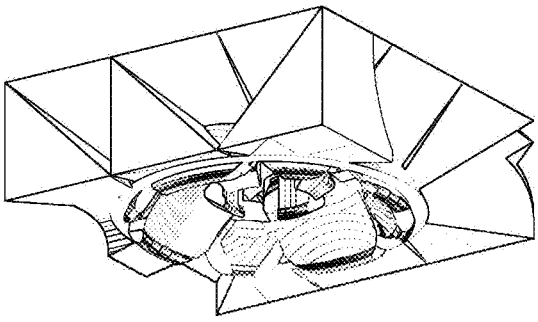
FIG. 23C is a view from the bottom of FIG. 23A.
Figure 23D:
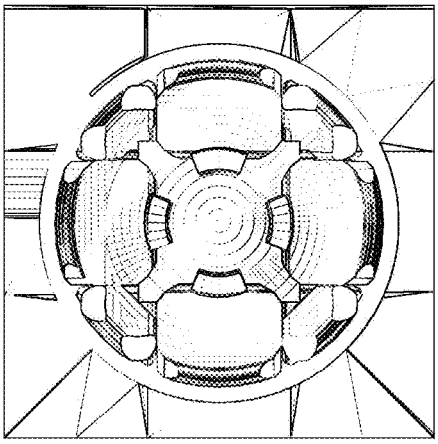
FIG. 23D is a profile view from the bottom of FIG. 23A.

FIG. 23A is a view of how the preceding FIGS. 14A-22B (65, 66, 67, 68, 69) fit.

Figure 24A:
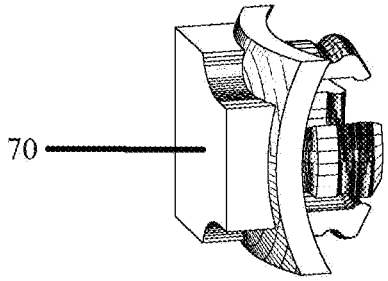
FIG. 24A is a middle piece of FIG. 1A.
Figure 24B:
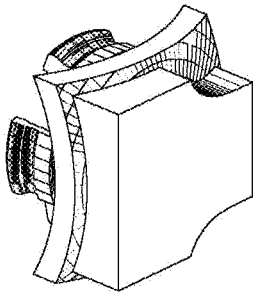
FIG. 24B is a different view of FIG. 24A.
Figure 25A:
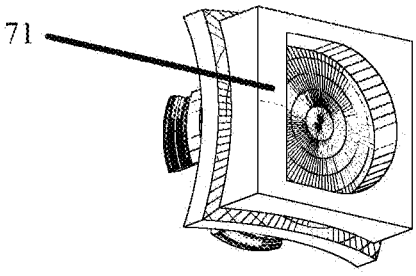
FIG. 25A is a middle piece of FIG. 1A.
Figure 25B:
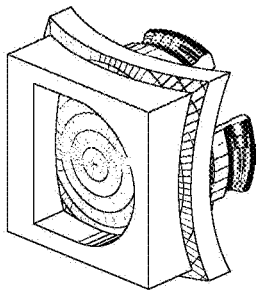
FIG. 25B is a different view of FIG. 1A.
Figure 26A:
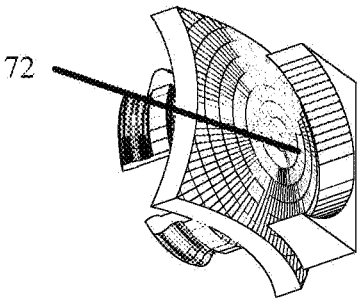
FIG. 26A is a middle piece of FIG. 1A.
Figure 26B:
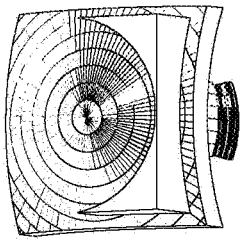
FIG. 26B is a different view of FIG. 26A.
Figure 27A:
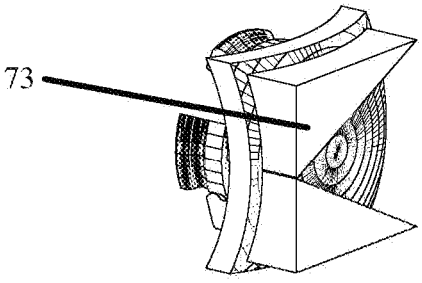
FIG. 27A is a middle piece of FIG. 1A.
Figure 27B:
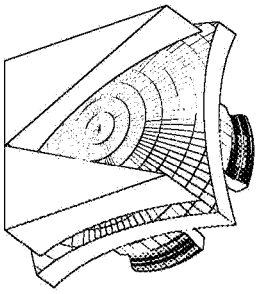
FIG. 27B is a different view of FIG. 27A.
Figure 28A:
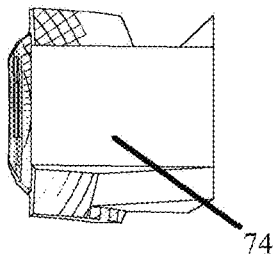
FIG. 28A is a corner piece of FIG. 1A.
Figure 28B:
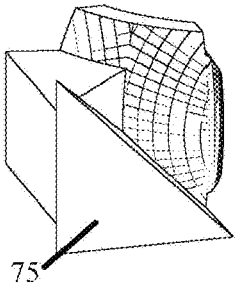
FIG. 28B is a different view of FIG. 28A.
Figure 29A:
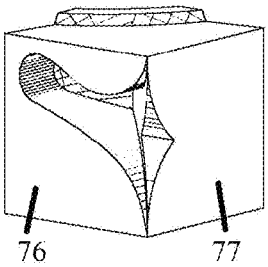
FIG. 29A is a corner piece of FIG. 1A.
Figure 29B:
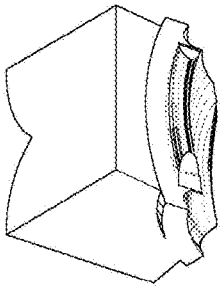
FIG. 29B is a different view of FIG. 29A.
Figure 30A:
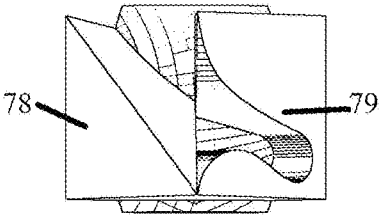
FIG. 30A is a corner view of FIG. 1A.
Figure 30B:
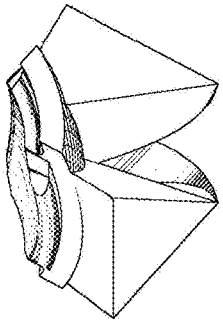
FIG. 30B is a different view of FIG. 30A.
Figure 31A:
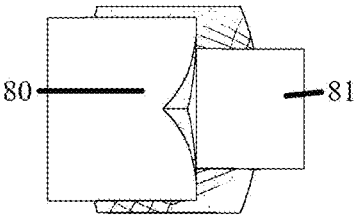
FIG. 31A is a corner piece of FIG. 1A.
Figure 31B:
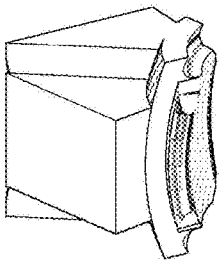
FIG. 31B is a different view of FIG. 31A.
Figure 32A:
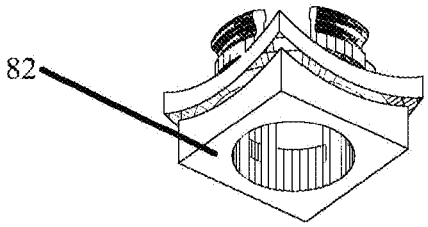
FIG. 32A is a center piece of FIG. 1A.
Figure 32B:
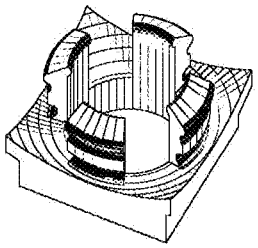
FIG. 32B is a different view of FIG. 32A.
Figure 33A:
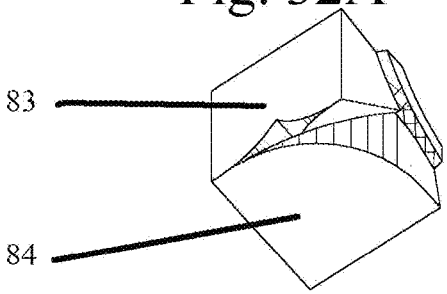
FIG. 33A is a middle piece of an edge of FIG. 1A.
Figure 33B:
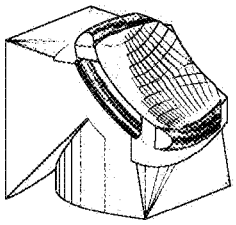
FIG. 33B is a different view of FIG. 33A.
Figure 33C:
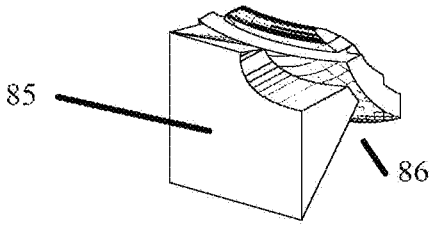
FIG. 33C is a middle piece of an edge of FIG. 1A.
Figure 33D:
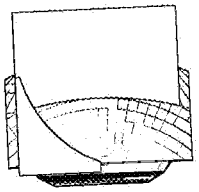
FIG. 33D is a different view of FIG. 33C.
Figure 34A:
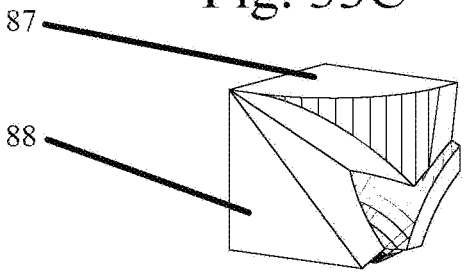
FIG. 34A is a middle piece of an edge of FIG. 1A.
Figure 34B:
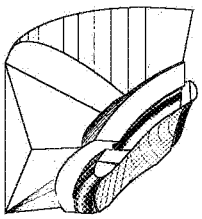
FIG. 34B is a different view of FIG. 34A.
Figure 35A:
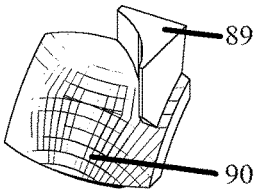
FIG. 35A is a middle edge piece of FIG. 1A.
Figure 35B:
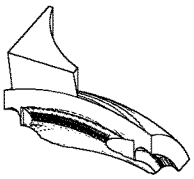
FIG. 35B is a different view of FIG. 35A.
Figure 36A:
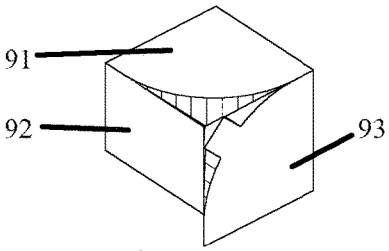
FIG. 36A is a corner piece of FIG. 1A.
Figure 36B:
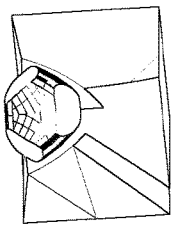
FIG. 36B is a different view of FIG. 36A.
Figure 37A:
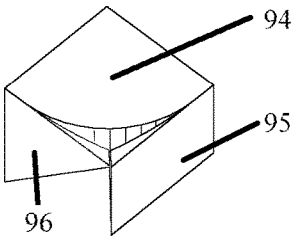
FIG. 37A is a corner piece of FIG. 1A.
Figure 37B:
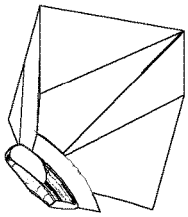
FIG. 37B is a different view of FIG. 37A.
Figure 38A:
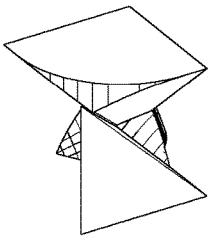
FIG. 38A is a corner piece of FIG. IA.
Figure 38B:
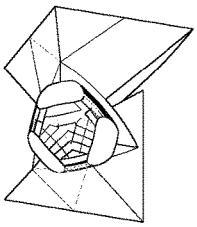
FIG. 38B is a different view of FIG. 38A.
Figure 39A:
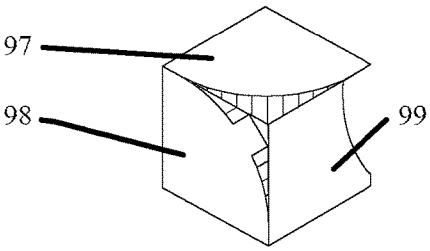
FIG. 39A is a corner piece of FIG. 1A.
Figure 39B:
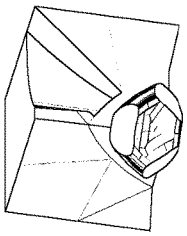
FIG. 39B is a different view of FIG. 39A.

FIG. 24A-39B follow the same logic as that of FIG. 14A-22A for the remainder of the cube to assemble it so it forms the cube shown in FIG. 1A that solves for each letter of the alphabet in the manner shown in FIG. 2. FIG. 24A is a middle piece (70) that forms the middle "M" "W" and "B" letters. FIG. 25A is a middle piece (71) that forms the middle of letters "D" and "A." FIG. 26A is a middle piece (72) that forms the middle of letters "U" "C" "G" and "J." FIG. 27A is a middle piece (73) that forms the middle of letters "V" "K" and "Y." FIG. 28 is a middle side piece that forms the middle side of letters "E" and "F" (74) and that also forms middle sides of letters "Y" and "Z" (75). FIG. 29 forms the middle side of letters "S" (76) and "W" "IM" and "B" (77). FIG. 30 is a middle piece that forms the middle side of letters "Y" and "Z" (78) and of the letter "S" (79). FIG. 31 is a middle side piece that forms the middle side of letters "B" "M" and "W" (80) and the middle side of letters "E" and "F" (81). FIG. 32 is a circular middle piece (82) that forms the center of letters "O" "Q" "R" and "P." FIG. 33 is a middle side piece that forms the middle side of letters "B" "W" and "M" (83) and the middle side of letters "P" "R" (84). FIG. 33 is a middle side piece that forms the top middle and bottom middle of the letter "B" (85) and that forms blank white side middle parts of letters "T" "L" "J" "I" "X" "U" "Y" "K" "C" "H" "V" and "X" (86). FIG. 34 is a middle side piece that forms the middle side of letters "P" and "R" (87) and the middle side of letter "Y" (88). FIG. 35 is a middle side piece that forms the middle bottom of "R" (89) and blank middle parts of letters "T" "L" "J" "I" "X" "U" "Y" "K" "C" "H" "V" and "X" (90). FIG. 36 is a corner piece that forms the corners of letters "O" "Q" "P" "D" "C" "G" "J" "R" "S" "W" "U" "M" and "B" (97). It also forms the corner of letter "Q" (98) and of letter "R" (99).

Figure 40:
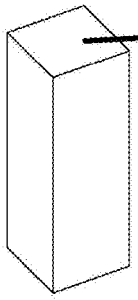
Figure 46:
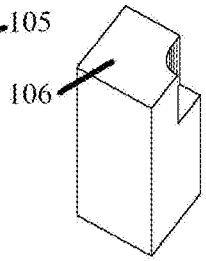
Figure 47:
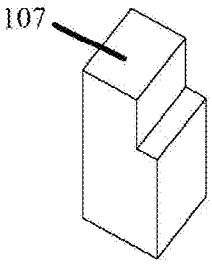
Figures 48, 49:
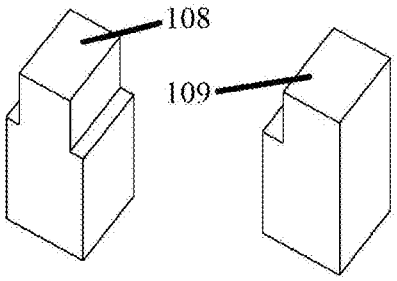
Figures 50, 51, 52:
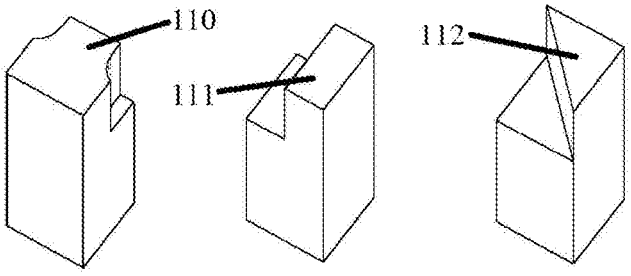
Figure 53:
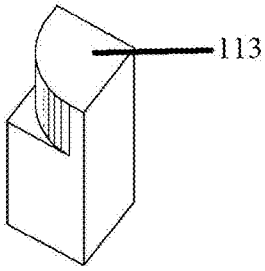
Figure 54:
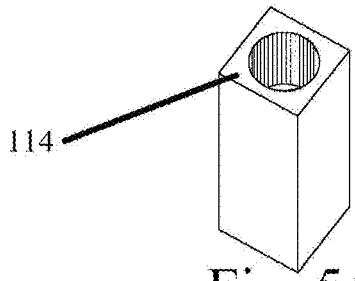
Figure 55:
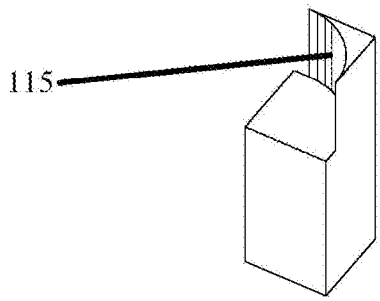
Figure 56:
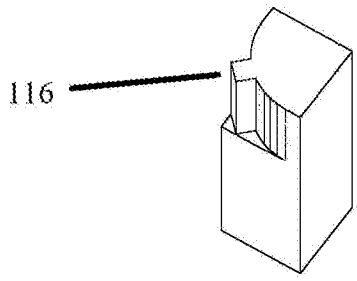
Figure 57:
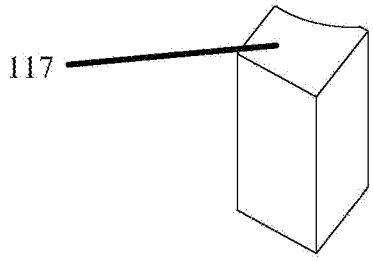
Figure 58:
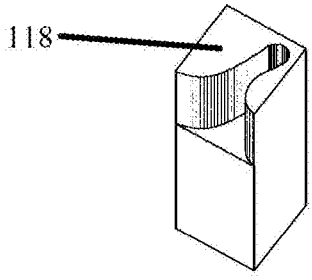
Figure 59:
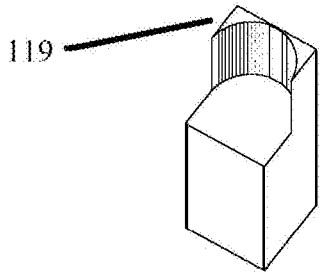
Figure 60:
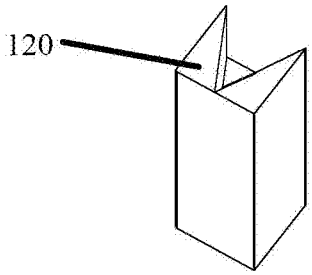

The ends of FIG. 40-FIG. 60 contain the shapes that are found in FIG. 2 so that FIGS. 40 through 60 are modular blocks that assemble into those letters. FIG. 40 forms all the solid black boxes in the letters in FIG. 2 (100). The empty space on top of FIG. 41 (101) forms the blank middle parts of letters "T" "L" "J" "I" "X" "U" "Y" "K" "C" "H" "V" and "X." The top of FIG. 42 (102) forms the middle side parts of letters "B" "<W" and "M." The top of FIG. 43 (103) forms the middle of letters "D" and "A." The top of FIG. 44 (104) forms the middle of letters "W" and "M" in FIG. 2. The top of FIG. 45 (105) forms the middle bottom of letter "B" in FIG. 2. FIG. 46 (106) forms the middle top of letter "B" in FIG. 2. The top of FIG. 47 (107) forms the corner ends of letters "F" and "E" in FIG. 2. The top of FIG. 48 (108) forms the middle side of letters "E" and "F." The top of FIG. 49 (109) forms the corners of the letters "E" "F" "M" and "W." The top of FIG. 50 (110) forms the middle of letters "M" "W" and "B." The top of FIG. 51 (111) forms the edges of letters "W" "M" "E" and "F." The top of FIG. 52 (112) forms the middle side of letters "Y" and "Z." the top corners of letter "A," the bottom corners of letter "V," the slanted portions of letter "K," and the outer portions of letter "X." FIG. 53 is a corner piece that forms the corners of letters "O" "Q" "P" "D" "C" "G" "J" "R" "S" "W" "U" "M" and "B" (113). The top of FIG. 54 (114) forms the middle of letters "O" "Q" "P" and "R." The top of FIG. 55 (115) forms the middle bottom of letter "R." The top of FIG. 56 (116) forms the bottom right corner of the letter "Q." The top of FIG. 57 (117) forms the bottom right corner of letter "R." The top of FIG. 58 (118) is the middle sides of the letter "S." The top of FIG. 59 (119) is the middle of letter "U" "C" "G" and "J." The top of FIG. 60 (120) is the middle of letters "V" "Y" and "K."

The shapes at FIG. 14A-39B are part of a twisty puzzle that can be solved for each letter of the alphabet to form the fonts shown in FIG. 2.

The shapes at FIGS. 40 through 60 can be arranged into the entire alphabet shown in FIG. 2.

The shapes at FIGS. 40 through 60 can be stacked to form a wall that writes letters, which in turn spell words and sentences. The shapes are modular pieces that can be used interchangeably to make letters, write words, and build walls at the same time.

Figure 41:
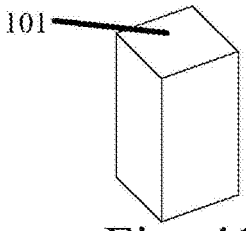
Figure 42:
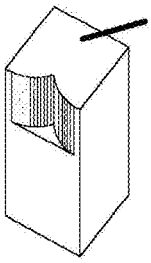
Figure 43:
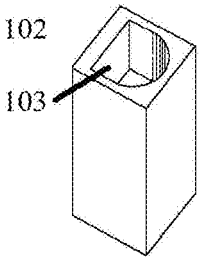
Figure 44:
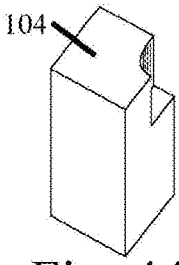
Figure 45:
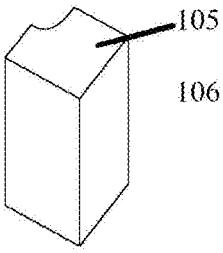

The ends of FIG. 40 through FIG. 60 contain the shapes that are found in FIG. 2 so that FIGS. 40 through 60 are modular blocks that assemble into those letters. The black is represented by positive space and white is recessed space. FIG. 40 is a fully black piece (100) for example and FIG. 41 is a fully white piece (101). FIG. 42 is a combination of white and black that shows the middle right part of the letter "B" (102) FIGS. 40 through 60 can be assembled into cubes that have the same height, width and depth of the earlier cubes. None of the cubes have a specific length, width or depth. What is important is the ratios of their measurements. For example, when nine sticks in FIGS. 40 through 60 are assembled to form a letter in FIG. 2 the nine assembled pieces will also form a cube that is generally equilateral. This means the general dimensions of the assembled cube will be that it has the same length, depth and width. This means it can be a stable building block.

FIGS. 40 through 60 can assemble into vertical walls that also contain verbal messages. They can also be assembled into walkways or horizontal locations to also form messages. FIGS. 40 through 60 can be used together. One letter can be written with one approach and another can be written with another approach.

The letters can be used as toys for children to learn and play, to be the address on a home, the name of a family in a house, the name of a restaurant, and many, many more purposes.

The invention claimed is:

1. A building system comprising:

a plurality of alphabet blocks, each of said blocks having a protruding space and a receding space, a subset of nine of said alphabet blocks capable of being arranged and configured to spell each capital letter of the English alphabet, wherein each said capital letter being formed from said blocks is formed within a three-block by three-block grid;

wherein a first shape of some of said alphabet blocks is comprised of a solid block that has entirely smooth surfaces that make up one-ninth of a positive space of said grid that spells said capital letters including "A", "B", "C", "D", "E", "F", "G", "H", "I", "J", "K", "L", "M", "N", "O", "P", "Q" "R", "S", "T", "U", "V", "X", "Y," and "Z";

wherein a second shape of some of said alphabet blocks is comprised of a block with a fully recessed space that makes up one-ninth of an empty space of said grid in said capital letters "A", "C", "F", "H", "I", "J", "K", "L", "T", "U", "V", "X" and "Z";

wherein a third shape of some of said alphabet blocks is comprised of a center block with a fully protruding side with a recessed area in a center of said third shape, said recessed area having a first flat surface and a semicircular second surface joining said first flat surface to forming a shape of a capital "D", said third shape configured for use of a middle of said capital letters "A" and "D";

wherein a fourth shape of some of said alphabet blocks is comprised of a U-shaped block that has a first protruding portion that is one-half the width of said first shape block, and a semi-circular shape subtracted from said protruding portion so as to be configured to form a center part of said capital letters "C", "G", "J" and "U";

wherein a fifth shape of some of said alphabet blocks is comprised of a block that has a protruding portion with a one-fourth circle subtracted from a first left corner, when viewed in plan, so as to form one-ninth of said capital letters "B", "M" and "W";

wherein a sixth shape of some of said alphabet blocks is comprised of a block that has a protruding portion with a one-fourth circle subtracted from a second left corner, said second left corner being opposite said first left corner when viewed in plan, so as to form one-ninth of said capital letters "B", "M" and "W";

wherein a seventh shape of some of said alphabet blocks is comprised of a block that has a protruding portion with one-fourth circles subtracted from two corners on one side of said respective blocks so as to form one-ninth of said capital letters "B", "M" and "W";

wherein an eighth shape of some of said alphabet blocks is comprised of a block that has a protruding side in the shape of one-fourth of a circle extending from one corner to a diagonally opposite corner of said block with so as to form rounded portions of said capital letters "B", "C", "D", "G", "J", "M", "O", "P", "Q", "R", "S", "U" and "W";

wherein a ninth shape of some of said alphabet blocks is comprised of a bump block that has a protruding space on one side and an indentation of negative space that causes a second side to have two rounded portions so as to form one-ninth of said capital letters "B", "M" and "W";

wherein a tenth shape of some of said alphabet blocks is comprised of a line block that has receding space on one side that is interrupted in a respective middle portion with a protruding linear portion so as to form one-ninth of said capital letters "E", "F", "M and "W";

wherein an eleventh shape of some of said alphabet blocks is comprised of an edge-line block that has a receding space wherein said receding space is interrupted on one side by a protruding linear portion so as to form one-ninth of said capital letters "E", "F" and "M";

wherein a twelfth shape of some of said alphabet blocks is comprised of a one-half block that has a one-half receding space and a one-half protruding space so as to form one-ninth of said capital letter "G;"

wherein a thirteenth shape of some of said alphabet blocks is comprised of a V-block that has protruding area with a receding area in the form of a triangle, said triangle having a base is on one edge of said V-block so as to form one-ninth of said capital letters "V", "K" and "Y";

wherein a fourteenth shape of some of said the alphabet blocks is comprised of a hole-block comprised of a fully protruding side with a circular hole formed in a middle of said respective block so as to form one-ninth of said capital letters "O", "P", "Q", and "R";

wherein a fifteenth shape of some of said alphabet blocks is comprised of a Q-block that has protruding space in the shape of a lower right portion when viewed in plan of the letter "Q" so as to form one-ninth of said capital letter "Q;"

wherein a sixteenth shape of some of said alphabet blocks is comprised of an "S" block that has a protruding curved area so as to form one-ninth of two sides of said capital letter "S".

* * * * *